United States Patent [19]

Hoyt

[11] Patent Number: 4,706,590

[45] Date of Patent: Nov. 17, 1987

[54] DECK MOUNTED LATERAL MAST RAKE ADJUSTER

[76] Inventor: John G. Hoyt, One Harbor View Dr., Newport, R.I. 02840

[21] Appl. No.: 924,332

[22] Filed: Oct. 29, 1986

[51] Int. Cl.[4] ..... B63B 15/00

[52] U.S. Cl. ..... 114/39.1; 114/91; 114/93

[58] Field of Search ..... 114/39.1, 56, 61, 89–91, 114/93, 122, 348

[56] References Cited

U.S. PATENT DOCUMENTS

| | | | |
|---|---|---|---|
| 1,916,459 | 7/1933 | Blackman | 114/91 |
| 2,353,007 | 7/1944 | Blackman | 114/91 |
| 3,487,800 | 1/1970 | Schweitzer et al. | 114/91 |
| 3,610,190 | 10/1971 | Palmer | 114/91 |
| 3,972,300 | 8/1976 | Adamski | 114/39 |
| 4,345,535 | 8/1982 | Ross | 114/91 |
| 4,501,215 | 2/1985 | Hart et al. | 114/39 |

*Primary Examiner*—Jeffrey V. Nase
*Assistant Examiner*—Stephen P. Avila
*Attorney, Agent, or Firm*—Barlow & Barlow, Ltd.

[57] ABSTRACT

A sailing vessel is disclosed in which a mast is pivotally connected to the hull at the lower end thereof and an athwartship structure is provided in the form of a support rigidly mounted to the hull and transverse thereto to guide the mast athwartship. The mast may be held in an upstanding attitute or an angular attitude by mechanical devices of lines or other adjusting means. Bringing the mast and the sail mounted thereon to a vertical attitude reduces the heeling moment that affects the vessel.

5 Claims, 7 Drawing Figures

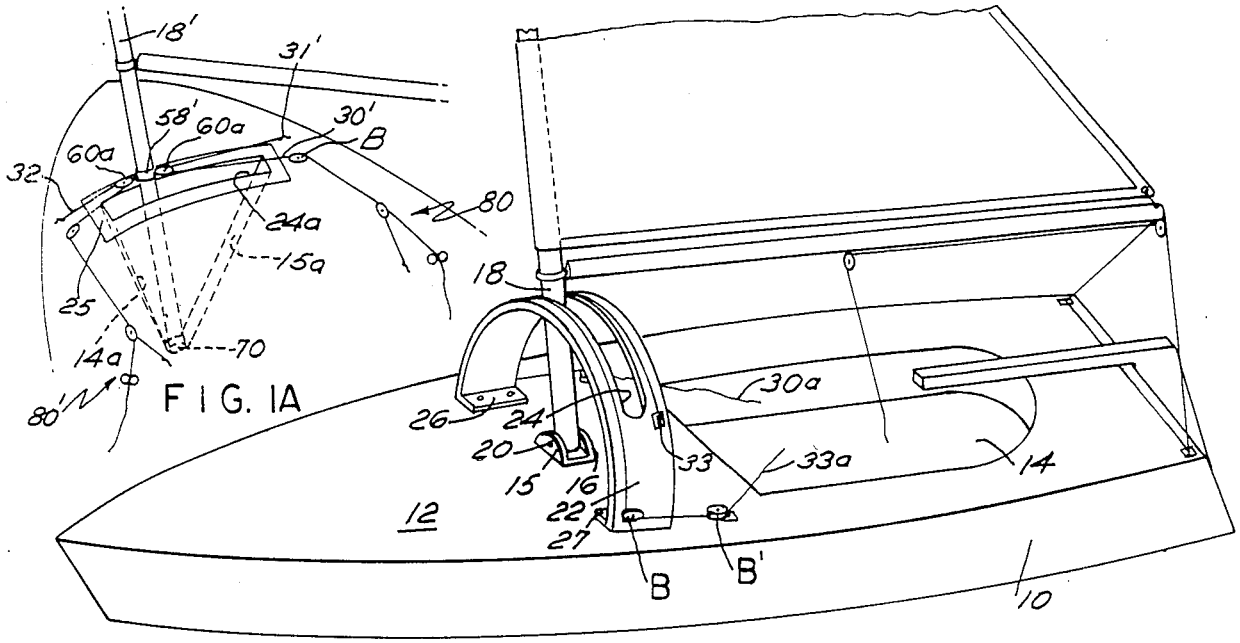
FIG. 1A
FIG. 1
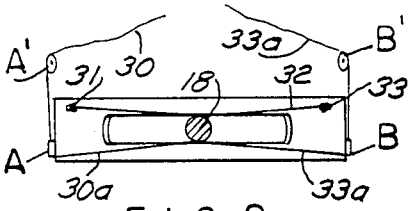
FIG. 2
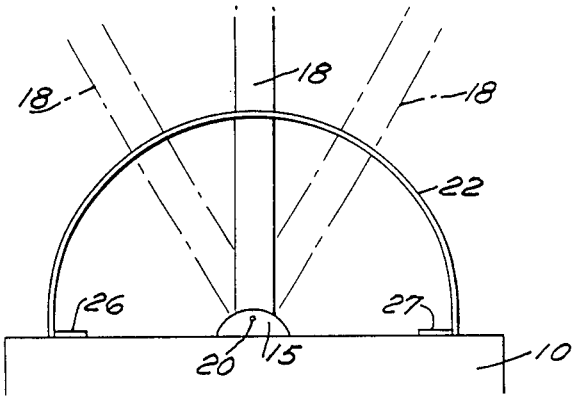
FIG. 3
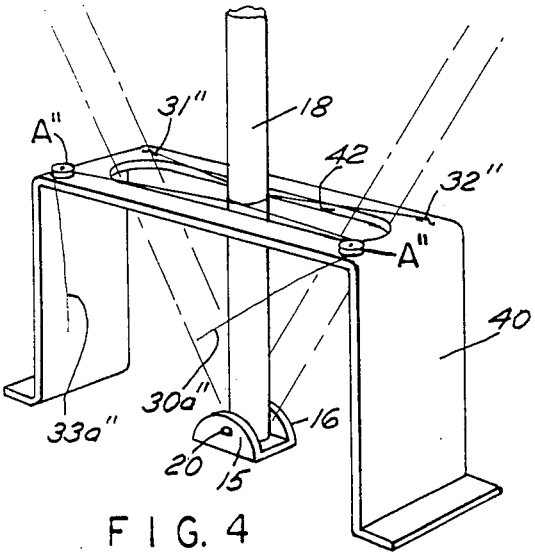
FIG. 4
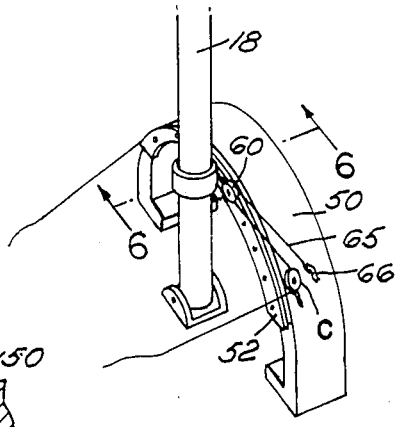
FIG 5
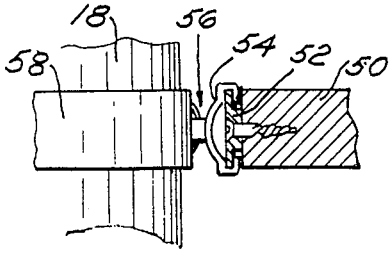
FIG. 6

DECK MOUNTED LATERAL MAST RAKE ADJUSTER

BACKGROUND OF THE INVENTION

This invention relates to a system for pivoting a mast and the sail thereon by providing a pivoting mast step so that lateral adjustment of the rig may be achieved.

One of the interesting features that has come from sail board sailing is found in the tilting mast arrangement whereby the mast is essentially supported by a swivel on the deck of the board and may be rotated in any direction. In sailing a board, it has been noticed that if one rocks the mast to windward, the heeling moment that is created by the sail may be changed to an upward lift. This is in contrast to a conventional boat with a fixed mast where the whole structure of the mast and the vessel lean to leeward and there is a speed penalty taken because of the extra downward pressure by the sail.

Some attempts at pivoting masts are seen in the prior art. For example, a spar is pivoted to an upright post in Blackman U.S. Pat. No. 1,916,459 and Ross U.S. Pat. No. 4,345,535, while the classical sail board is seen in Schweitzer U.S. Pat. No. Re. 31,167.

SUMMARY OF THE INVENTION

The instant invention comprises an arcuate, semi-circular or U-shaped rigid bar structure mounted at or above the deck of a sail boat which provides upper support for a mast and sail, and in conjunction with a pivoting mast step allows for lateral adjustment of the rig, that is, a pivoting of the mast. This lateral adjustment of the mast is provided by various mechanical means. Essentially, the arrangement provides a system for obtaining upward lift force without the need for human support. It is adaptable for larger vessels than a conventional sail board where the rig or the mast and the sail is limited in size as to what a human being can hold against the force of the wind, which in practical terms means a sail of approximately 100 sq. feet in area.

It is an object of this invention to provide an inclinable rig wherein the mast may be tilted laterally on the sail boat hull without requiring the operator to hold up the mast.

BRIEF DESCRIPTION OF THE DRAWINGS

FIG. 1 is a partial perspective view of a sail boat with one form of a mast rake adjuster of the invention;

FIG. 1A is a similar view of a modified form;

FIG. 2 is a plan view of the support for the mast;

FIG. 3 is an end view of the support for the mast;

FIG. 4 is a perspective illustration of an alternate form of support for the mast;

FIG. 5 is a perspective view of still another form of support for the mast; and FIG. 6 is a sectional view taken on line 6—6 of FIG. 5.

DESCRIPTION OF THE PREFERRED EMBODIMENTS

Referring now in more detail to the drawing, FIG. 1 illustrates a sail boat with a centerboard or equal (not shown) which has a deck 12, rudder and tiller 13 and cockpit 14. Mounted on the deck 12 are a pair of spaced plates 15, 16. A mast 18 is pivoted to the plates 15 and 16 by a clevis pin 20.

A mast support or roll bar 22 is seen in FIG. 1 as comprising a semi-circular formed strap metal piece with a slot 24 therein. At either end thereof are inturned ends 26, 27 that provide a fastening means for the support. The mast support as will be seen by examining the drawings extend transversely with respect to the center line of the boat or, stated in another way, athwartships. In order to control the position of the mast and maintain it in adjusted position, a pair of lines are provided which in their most simplistic version, as seen in FIG. 2, consist of lines 30 and 32. Line 30 is anchored as in 31 and thence extends about one semi-circular of the mast to return as at **30*a* thru suitable lead guides or sheaves A, A′ to the cockpit 14. Similarly a line 32, anchored as at 33, extends about the mast in a complementary semi-circular direction to return via lead sheaves B, B′ to the cockpit at 33*a*. Essentially with this arrangement the mast may be tilted to one side or the other as seen more particularly in FIG. 3** by the broken lines.

In FIG. 1A there is shown a version of the invention where the athwartship support is located at the deck level of the boat. In this version a watertight truncated sleeve having opposite side walls **14*a*, 5*a* has a top opening slot 24*a* defined by formed flanges 25 thereabout. The mast 18′ seats at the bottom of the sleeve at a bottom wall portion 70. For more power advantage, the mast is fitted with a sleeve 58′ to which two clocks 60′,60*a*′ are attached. A line 30′ is fastened at 31′ and then passes through block 60*a*′ and lead block B, where the dead end is fastened to a 2:1 power advantage block arrangement generally designated 80. A similar arrangement is provided for the port side line 32′**.

By way of illustration, let us assume that the boat is on the port tack in which case the line portion **33*a* will be tightened while line 30*a* is loosened, thus raking the mast away from the paper as seen in FIG. 1, to the end of the slot 24**. In this fashion, the sail mounted on the mast and boom will be more nearly at the right angles to the direction of the wind and be in a position whereby additional forces will not create a heeling moment but will provide upward lift and lighten the boat. In addition the traditional cat boat rig may be made more manageable for downing sailing. Normally the rig develops a strong and uncontrollable weather helm when reaching or running. This is due to the fact that the center of effort moves out of the side when the boom is eased out and consequently a strong turning moment is created. Raking the mast laterally to windward will move the center of effort of the sail either over or close to the boat so that steering is improved.

Certain alternate structures suggest themselves and reference is now had to FIG. 4 where, in lieu of a semi-circular plate-like structure, a U-shaped structure 40 is provided with an aperture 42 while control lines identical to those in connection to FIGS. 1 and 2 are also provided, these being designated with a double prime.

Referring to FIGS. 5 and 6, another form a semi-circular structure is shown, and, in this case, the semi-circular structure 50 is provided with a flat plate track 52. A slider 54 fits on this track, the slider having a swivel connections as generally indicated at 56 which swivel connection grasps a collar 58 that may slide up and down the mast. Adjustment of this arrangement is provided by a pair of blocks 60 (only one being illustrated) which are attached to the slider sleeve arrangement and adjustment lines such as 65 that are anchored at 66 and passed through through guide blocks such as C to extend rearwardly into the cockpit area of the boat.

I claim:

1. A sailing vessel having a hull, means to establish directional control of the hull, a mast, means pivotally connecting the mast to the hull at the lower end thereof, a sail detachably secured to the mast, a unitary athwartships structure spaced substantially above the lower end of the pivotal mast for the sole support of the mast both fore and aft and athwartships and means connected to the mast for altering the angle of the mast relative to the hull.

2. A sailing vessel as in claim 1 wherein the athwartship structure is a semi-circular support, said semi-circular support having a track mounted on an edge portion thereof, said mast having a collar, means coupling said collar via a slider to said track.

3. A sailing vessel as in claim 1 wherein the athwartship structure is a truncated sleeve with spaced walls extending laterally of the vessel and a slot is defined at the deck level of the vessel, said mast being pivoted to the hull at the bottom of the said spaced walls.

4. A sailing vessel as in claim 1 wherein the means connected to the mast for altering the angle of the mast consists of a pair of lines attached to the mast and leading to either side of the hull.

5. A sailing vessel having a hull, means to establish directional control of the hull, a mast, means pivotally connecting the mast to the hull at the lower end thereof, a sail detachably secured to the mast, an athwartships structure spaced above the pivotal mast for supporting the mast both fore and aft and athwartships, first and second sheave means mounted on said structure and first and second line means provided anchored to said structure, said each line means passing through one each sheave means to be attached to said mast whereby releasing one line and applying force to the other will pivot the mast relative to hull.

* * * * *